US006481837B1

(12) United States Patent
Askren et al.

(10) Patent No.: US 6,481,837 B1
(45) Date of Patent: Nov. 19, 2002

(54) INK DELIVERY SYSTEM

(76) Inventors: Benjamin Alan Askren, 297 Taylor Dr., Lexington, KY (US) 40511; Ronald Willard Baker, 806 Pheasant La., Versailles, KY (US) 40383; Philip Jerome Heink, 3334 Mantilla Dr., Lexington, KY (US) 40513; Jeffrey Lynn Richie, 124 Wilson Downing Rd., Lexington, KY (US) 40517; Donald Wayne Stafford, 203 Betsy La., Richmond, KY (US) 40475

( * ) Notice: Subject to any disclaimer, the term of this patent is extended or adjusted under 35 U.S.C. 154(b) by 0 days.

(21) Appl. No.: 09/920,043

(22) Filed: Aug. 1, 2001

(51) Int. Cl.[7] ..... B41J 2/175; B41J 2/19
(52) U.S. Cl. ..... 347/85; 347/92
(58) Field of Search ..... 347/85, 86, 87, 347/92, 89, 93

(56) References Cited

U.S. PATENT DOCUMENTS

| | | | | |
|---|---|---|---|---|
| 5,153,612 | A | | 10/1992 | Dunn et al. |
| 5,182,581 | A | | 1/1993 | Kashimura et al. |
| 5,233,369 | A | | 8/1993 | Carlotta et al. |
| 5,289,212 | A | | 2/1994 | Carlotta |
| 5,409,138 | A | | 4/1995 | Nakano |
| 5,426,459 | A | | 6/1995 | Kaplinsky |
| 5,440,333 | A | | 8/1995 | Sykora et al. |
| 5,448,275 | A | | 9/1995 | Fong |
| 5,467,118 | A | | 11/1995 | Gragg et al. |
| 5,481,289 | A | | 1/1996 | Arashima et al. |
| 5,485,187 | A | * | 1/1996 | Okamura et al. ..... 347/85 |
| 5,505,339 | A | | 4/1996 | Cowger et al. |
| 5,537,136 | A | | 7/1996 | Brandon et al. |
| 5,541,632 | A | | 7/1996 | Khodapanah et al. |
| 5,594,483 | A | | 1/1997 | Kaplinsky et al. |
| 5,625,396 | A | | 4/1997 | Keefe et al. |
| 5,648,805 | A | | 7/1997 | Keefe et al. |
| 5,657,065 | A | | 8/1997 | Lin |
| 5,751,313 | A | | 5/1998 | Miyashita et al. |
| 5,757,406 | A | | 5/1998 | Kaplinsky et al. |
| 5,760,806 | A | | 6/1998 | Oda et al. |
| 5,777,647 | A | | 7/1998 | Pawlowski, Jr. et al. |
| 5,786,834 | A | | 7/1998 | Carlotta et al. |
| 5,815,183 | A | | 9/1998 | Sasaki |
| 5,841,455 | A | | 11/1998 | Tanaka et al. |
| 5,844,577 | A | | 12/1998 | Pawlowski, Jr. et al. |
| 5,847,730 | A | | 12/1998 | Miyashita et al. |
| 5,847,734 | A | * | 12/1998 | Pawlowski et al. ..... 347/86 |
| 5,852,459 | A | | 12/1998 | Pawlowski, Jr. |
| 5,870,125 | A | | 2/1999 | Swanson et al. |
| 5,880,748 | A | | 3/1999 | Childers et al. |
| 5,912,688 | A | | 6/1999 | Gragg |
| 5,929,882 | A | | 7/1999 | Sharpe |
| 5,936,650 | A | | 8/1999 | Ouchida et al. |
| 5,943,078 | A | | 8/1999 | Nishimoto et al. |
| 5,992,987 | A | | 11/1999 | Childers et al. |
| 6,000,790 | A | | 12/1999 | Takagi et al. |
| 6,003,984 | A | | 12/1999 | Bohorquez et al. |
| 6,007,191 | A | | 12/1999 | Fujii et al. |
| 6,036,304 | A | | 3/2000 | Emanuel |
| 6,053,607 | A | | 4/2000 | Kaplinsky et al. |
| 6,058,984 | A | | 5/2000 | Sato |
| 6,059,405 | A | * | 5/2000 | Mochizuki et al. ..... 347/92 |
| 6,062,681 | A | | 5/2000 | Field et al. |
| 6,084,618 | A | | 7/2000 | Baker |
| 6,086,195 | A | | 7/2000 | Bohorquez et al. |

* cited by examiner

*Primary Examiner*—Michael Nghiem
(74) *Attorney, Agent, or Firm*—Taylor & Aust, P.C.

(57) ABSTRACT

An ink delivery system for an inkjet printing device has an ink cartridge, and a remote ink reservoir for containing a supply of ink. An air purge chamber is provided in flow communication between the reservoir and the cartridge. The air purge chamber includes a vent with a plug of hydrophobic material in the vent, and an outlet to the cartridge. The outlet communicates with a check valve leading to the cartridge. A screen of hydrophilic material is provided in the conduit, with a system for evacuating ink from the system to the reservoir when the printing device is not in use.

23 Claims, 2 Drawing Sheets

INK DELIVERY SYSTEM

BACKGROUND OF THE INVENTION

1. Field of the Invention

The present invention relates generally to ink jet printers, and, more particularly, the invention pertains to an ink delivery system for use in an ink jet printer.

2. Description of the Related Art

Ink jet printers are used commonly in offices and home printing applications. Ink jet printers are popular due to their low cost of operation, low energy use and quiet operating features. Ink jet printing involves the ejection of tiny ink droplets through small holes, in a controlled manner, to create the desired image on the media intended to receive the image. Ink is supplied from an ink reservoir to a printhead, which includes various passageways from the reservoir to a plurality of firing chambers having nozzle orifices. Energy is applied to the ink from an ink droplet generator near each orifice, which may include the application of electrostatic attraction, the application of oscillating forces from piezo elements, the application of heat from heating elements or the like.

It is known to provide the nozzle orifices in a printhead cartridge that is mounted on a carriage that may support one or more such printheads. The carriage traverses back and forth across the medium being printed, and ink droplets are emitted as the carriage moves. One of the ways in which ink jet printing can be made faster is simply to move the carriage faster as the ink droplets are emitted. In doing so, it is desirable to minimize the amount of ink contained within the cartridge carried on the carriage, to reduce the weight and thus the momentum of the carriage. Further, the repeated and abrupt reversal in movement direction of the carriage traversing back and forth across the media can create turbulence in the ink, which in turn can cause printing problems due to air absorption, ink foaming and the like.

For some large printing devices, such as plotters used to create drawings, posters or other large printing jobs; or for printers such as color printers and printers designed for high volume print service utilizing large volumes of ink in relatively short time periods, carrying a reasonable volume of ink in the ink cartridge on the carriage has become impractical. If a small volume of ink is carried to reduce weight and momentum of the carriage, frequent change is necessary as the ink supply is rapidly diminished. Alternatively, carrying a large volume of ink in the cartridge makes the cartridge large and heavy, neither of which is desirable for a fast moving carriage.

To satisfy the goal of reducing carriage weight, and to provide adequate ink volumes for printers requiring such, it has been known to provide large volume, off carriage ink reservoirs, which are stationary in the printer. A flexible tube connects the ink reservoir to the ink cartridge on the carriage, and only a small amount of ink need be carried within the cartridge itself.

However, the use of off carriage ink reservoirs presents its own unique set of problems. It is most often necessary to operate an off carriage ink delivery system at a slight negative or back pressure, to prevent ink dripping from the nozzles. However, back pressure that is too high can result in the printhead becoming deprimed, creating additional printing problems. Further, high back pressure can draw air into the ink supply system, which then can become trapped within the ink, causing even further printing problems.

It is known to use a pump to deliver ink from the ink reservoir to the ink cartridge, and to terminate ink supply when printing ceases. A check valve in the ink supply path can be used to deliver ink to the ink cartridge only when required.

Tubing used to connect an ink reservoir to an ink cartridge typically must have very low air permeability, to prevent gas from dissolving into the ink, which can cause print defects. Such tubing is expensive and has a limited life span.

When an emptied ink reservoir is removed from the system and replaced with a fill ink reservoir, air can be introduced into the ink delivery tubing. The air can become dissolved into the ink, causing the aforementioned printing problems. If not dissolved, the trapped air will eventually enter the cartridge, and an accumulation of air in the cartridge can prematurely end the life of a cartridge by starving the printhead for ink. Additionally, long-term storage of a printer with this type of system is limited by the possibility of ink drying in the ink delivery tubing. If the ink dries in the tubing, the printer will be non-functional.

What is needed is an ink delivery system that overcomes the aforementioned problems by providing means for removing air from the system and for evacuating ink from the ink delivery tubing during periods of non-use, while being economically practical to manufacture and supply.

SUMMARY OF THE INVENTION

The present invention provides an arrangement for removing air from an ink delivery system in an ink jet printer, and for evacuating ink from the system conduit during prolonged periods of printer inactivity.

The invention comprises, in one form thereof an ink delivery system having an ink cartridge and an ink supply item remote from the ink cartridge. The ink supply item includes an ink reservoir for containing a supply of ink. An air purge chamber is in flow communication between the reservoir and the cartridge, and includes a vent with a plug of hydrophobic material in the vent, and an outlet in fluid flow communication with the cartridge. The outlet includes a check valve. A conduit connects the air purge chamber and the reservoir in fluid flow communication, for delivering ink from the reservoir to the air purge chamber.

The invention comprises, in another form thereof an air purging system for an ink delivery system having a print cartridge and a remote ink reservoir, with a pump for delivering ink from the ink reservoir to the cartridge through a conduit. The air purging system has an air purge chamber disposed in fluid flow communication between the ink reservoir and the cartridge. The air purge chamber includes an inlet connected in flow communication to receive ink from the ink reservoir; an outlet having a check valve connected in flow communication to provide ink to the cartridge; and a vent open to an ambient environment. The vent has a plug of hydrophobic material therein for readily passing air therethrough while inhibiting the passing of ink therethrough.

The invention comprises, in yet another form thereof, a method for delivery ink from a remote reservoir to an ink cartridge, comprising steps of providing an air purge chamber disposed in fluid flow communication between the reservoir and the cartridge, the air purge chamber including an inlet connected in flow communication to receive ink from the reservoir and an outlet connected in flow communication to provide ink to the cartridge; providing a vent in the chamber open to an ambient environment and a plug of hydrophobic material in the vent; pumping ink from the reservoir to the chamber in response to a demand for ink by the ink cartridge; and passing air from the chamber to the ambient environment through the vent.

An advantage of the present invention is providing an ink delivery system with an ink reservoir of high volume remote from an ink cartridge, and a system having long component life.

Another advantage is providing an ink delivery system which reduces the potential for ink to clog the system during long term storage of a printer having the ink delivery system Yet another advantage is reducing the amount of air that will become dissolved in the ink during periods of printer inactivity, and alleviating the need for low gas permeable tubing.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
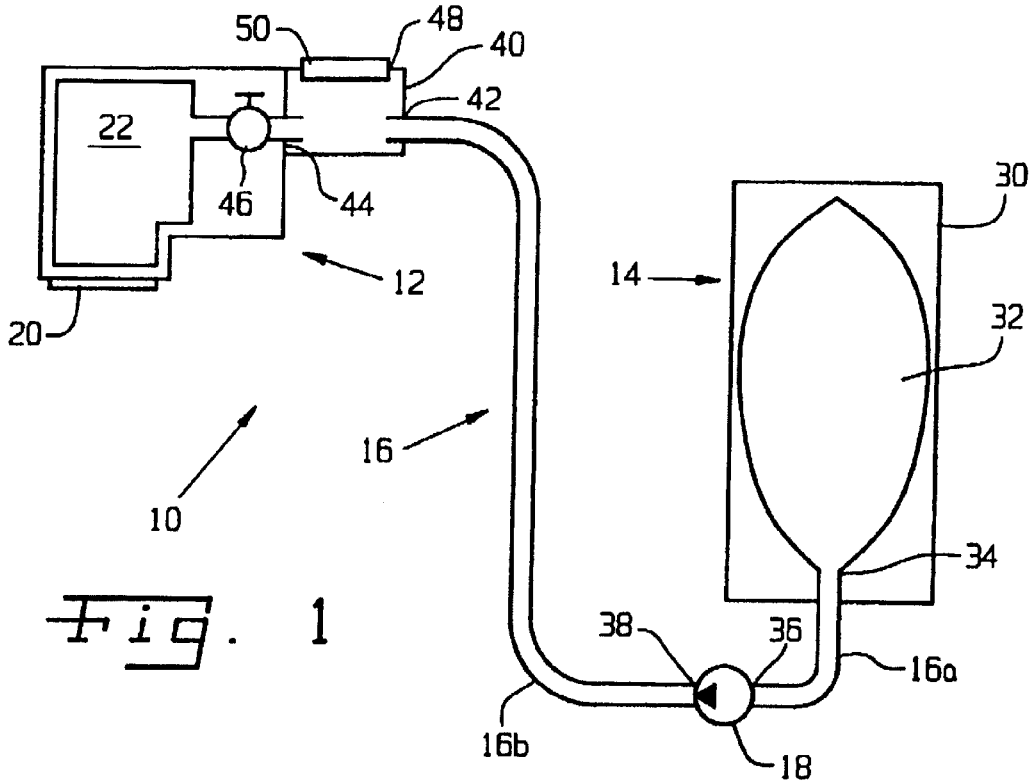
FIG. 1 is a view of an ink delivery system embodying the present invention.

Referring now to the drawings, and particularly to FIG. 1, there is shown an ink delivery system 10 of the present invention. Ink delivery system 10 can be used in an ink jet printer, plotter, fax machine or the like, and is particularly useful in a high speed, high volume printing application.

Ink delivery system 10 includes an ink cartridge 12 and an ink supply item 14. Ink supply item 14 is remote from ink cartridge 12, and an ink conduit 16, such as flexible tubing or the like, interconnects ink supply item 14 and ink cartridge 12, such that ink contained in ink supply item 14 can be transmitted to ink cartridge 12. A pump 18 is provided for moving ink from ink supply item 14 to ink cartridge 12 when replenishment of the ink in ink cartridge 12 is required.

Ink cartridge 12 is normally carried on a carriage of the printing device, which carriage traverses back and forth in close proximity to the media upon which the printed image is being formed. Ink cartridge 12 includes a printhead 20 having an array of nozzles (not shown) from which ink droplets are emitted in the desired pattern and sequence for creating the desired image on the media intended to receive the printed image. Ink cartridge 12 includes a small volume ink supply compartment 22, and ink ducts, channels, vias and the like (not shown), by which ink is supplied to firing chambers (not shown) within printhead 20. Ink droplet generators, such as piezo elements, heaters or the like are also provided. The structure and operation of an ink cartridge 12, including printhead 20 and the carriage on which cartridge 12 is mounted, are well known to those skilled in the art and will not be described in further detail herein.

Ink supply item 14 includes a housing 30 and an ink reservoir 32. Ink reservoir 32 may be a flexible bladder or the like, as those skilled in the art will readily understand, and includes an outlet 34 connected to conduit 16. Ink supply item 14 is mounted in a stationary manner in the printing device, and remains in place even as the carriage carrying ink cartridge 12 traverse back and forth during a printing operation. Ink conduit 16 is sufficiently long and flexible to move as required, to maintain fluid flow communication between ink cartridge 12 and ink supply item 14, even as cartridge 12 is moved during printing.

Pump 18 is disposed in conduit 16, and includes a pump inlet 36 and a pump outlet 38. Pump inlet 36 is connected to ink reservoir outlet 34 by a first length 16*a* of conduit 16.

In accordance with the present invention, ink delivery system 10 includes an air purge chamber 40 located between pump 18 and ink cartridge 12. In a preferred embodiment, air purge chamber 40 is disposed immediately adjacent ink cartridge 12. Air purge chamber 40 includes a chamber inlet 42 and a chamber outlet 44. Chamber inlet 42 is connected to pump outlet 38 by a second length 16*b* of conduit 16. Chamber outlet 44 is connected in flow communication with ink supply compartment 22 of ink cartridge 12. A pressure actuated check valve 46 is provided between chamber outlet 44 and ink supply compartment 22. Air purge chamber 40 includes a vent 48, at the top thererof, which comprises a hole or opening providing communication between the inside of air purge chamber 40 and the ambient environment. Vent 48 is filled with a vent plug 50 of hydrophobic mesh material, such as porous polyethylene or porous tetrafluoroethylene. A suitable hydrophobic material for vent plug 50 does not wet easily, and therefore retains a no-liquid pass property even as the material is contacted by ink entering air purge chamber 40. That is, liquid will not pass through the hydrophobic material of vent plug 50, and out of vent 48. Only air passes through the hydrophobic material of vent plug 50.

Figure 2:
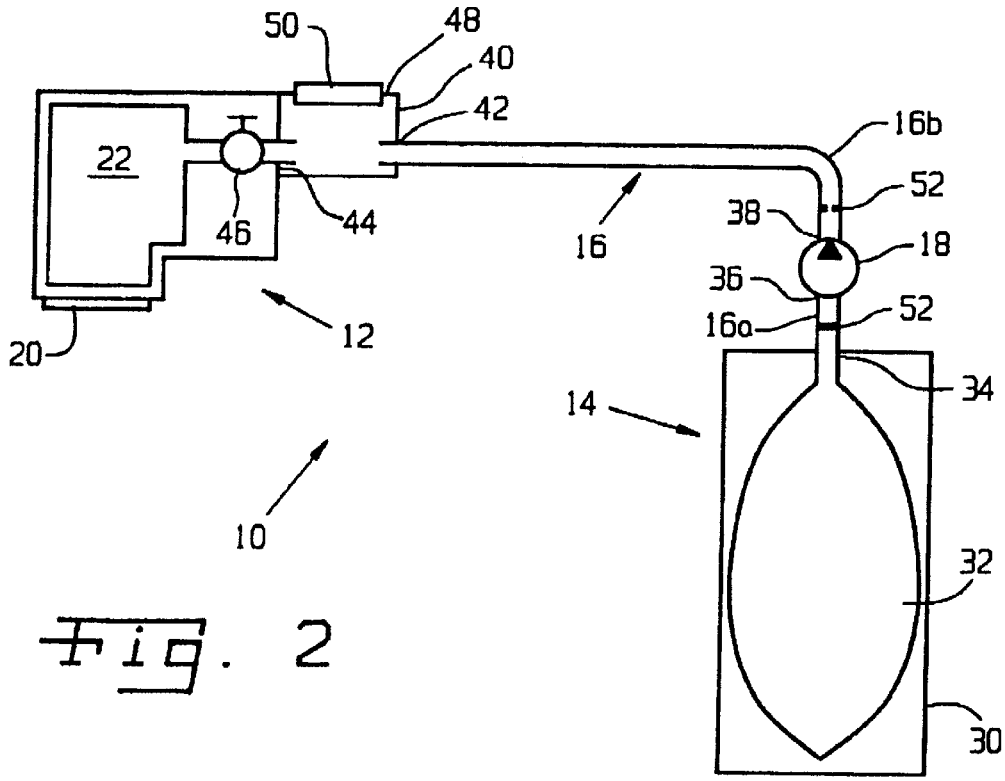
FIG. 2 is a view of an ink delivery system embodying a second feature of the present invention.

In accordance with a further feature of the present invention, as shown in FIG. 2, a filter 52 of hydrophilic mesh is provided in conduit 16. The hydrophilic mesh of filter 52 functions as an air check, to prevent air from entering the reservoir of ink supply item 14. Stainless steel filter screens commonly used in ink jet cartridges are examples of material suitable for the hydrophilic mesh of filter 52.

Figure 3:
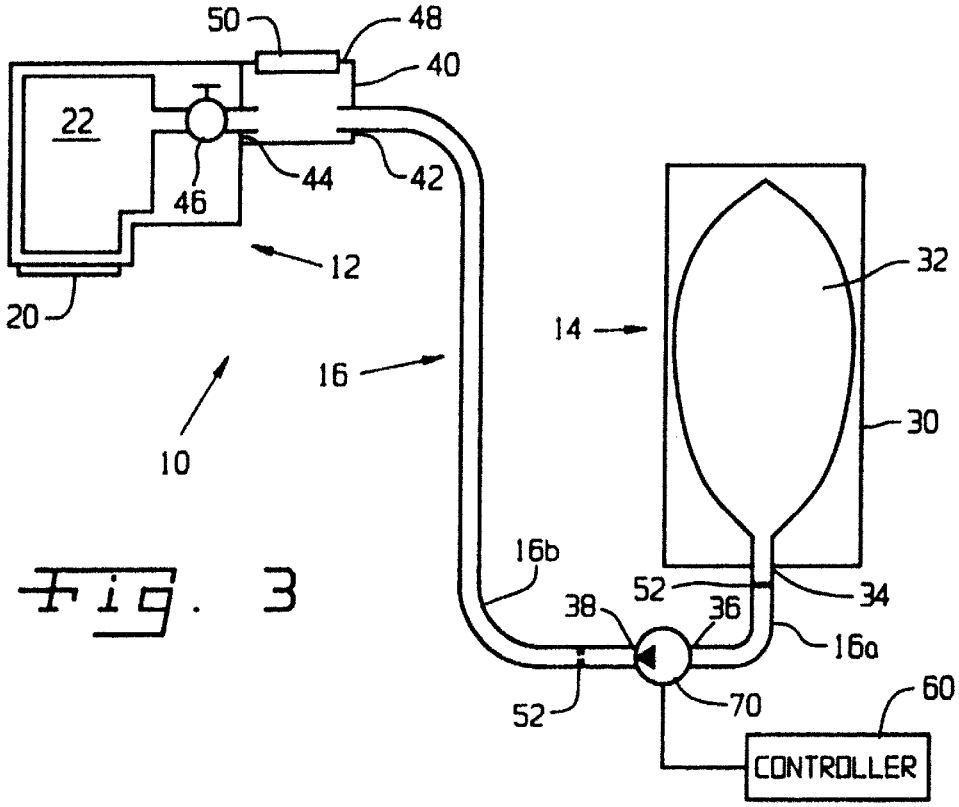
FIG. 3 is a view of an ink delivery system embodying a modification of the present invention.
Figure 4:
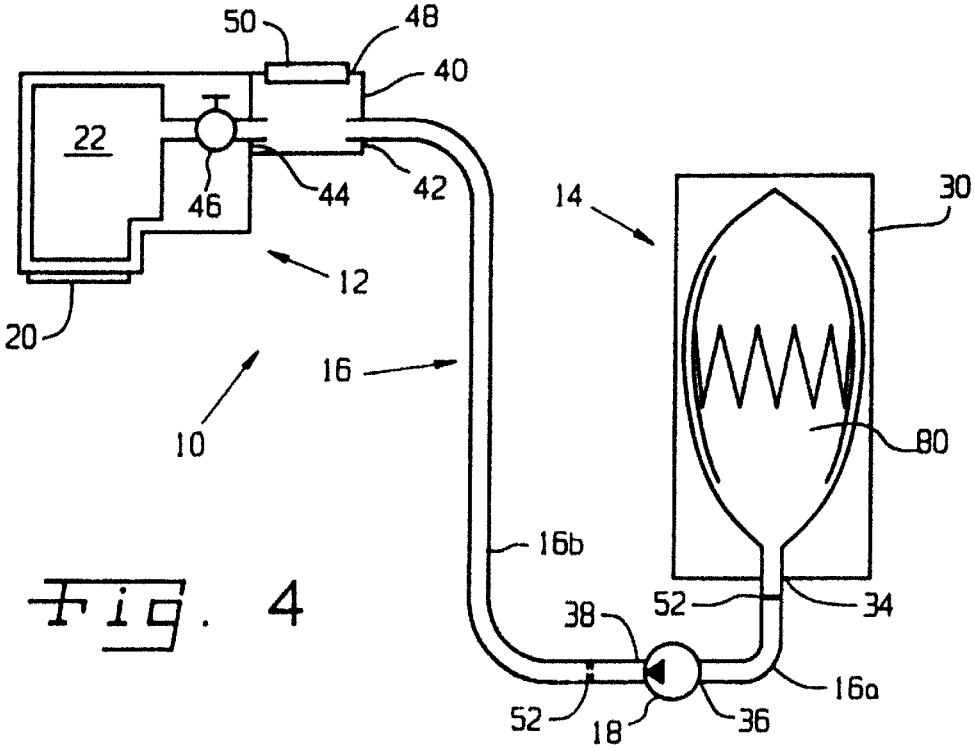
FIG. 4 is a view of a another modification of the present invention.

FIGS. 2, 3 and 4 show one filter 52 of hydrophilic material disposed upstream of pump 18, in first length 16*a* of conduit 16, between pump 18 and ink reservoir 32; and a second filter 52 downstream of pump 18, in second length 16*b* of conduit 16, between pump 18 and air purge chamber 40. The two locations for filter 52 are alternative locations, with only one such filter 52 being required in system 10.

For reasons to be explained subsequently, in the embodiment of ink delivery system 10 shown in FIG. 2, ink reservoir 32 is placed at a location lower than air purge chamber 40.

In the startup of a new print machine having an ink delivery system 10 as shown in FIG. 2, or when a new ink cartridge 12 is installed in the machine, the new ink cartridge 12 will normally contain a limited supply of ink in compartment 22, and does not have an immediate need for ink from ink supply item 14. Upon startup of a print job, pump 18 pulls ink from ink supply item 14 and drives the ink through conduit 16 to air purge chamber 40. Any air in conduit 16 is forced into chamber 40, ahead of ink coming from ink reservoir 32. As air purge chamber 40 fills with ink, vent 48 allows air pressurized in chamber 40 by the ink delivery pump to escape to atmosphere and be displaced by pressurized ink in air purge chamber 40. Because of the no liquid pass property of hydrophobic material in vent plug 50, ink does not leak from vent 48 of air purge chamber 40. Only air passes out of vent 48 through vent plug 50.

As printing progresses, and ink within ink supply compartment 22 is depleted, a vacuum is created sufficient to open check valve 46. Ink then flows from air purge chamber 40 into ink supply compartment 22 of ink cartridge 12. Pump 18 continues to supply ink to air purge chamber 40 from reservoir 32, and hence to compartment 22, so long as printing continues and vacuum is present in cartridge 12 sufficient to keep check valve 46 in an opened condition.

When the printing machine is powered off, or has been idle for an extended period of time, ink delivery pump 18 is deactivated and no longer maintains a positive pressure in ink delivery conduit 16. Due to the positional relationship between air purge chamber 40 and ink reservoir 32, in the embodiment of ink delivery system 10 shown in FIG. 2, hydrostatic pressure causes ink remaining in air purge chamber 40 and conduit 16 to drain back into ink reservoir 32, and be displaced by air drawn into ink delivery system 10 through vent 48. When the air/liquid boundary in conduit 16 reaches the hydrophilic mesh of filter 52, the menisci of ink in the hydrophilic mesh prevents air from entering ink reservoir 32.

Upon again powering on the printing machine, or reactivating an idled printing machine, air drawn in to air purge chamber 40 and conduit 16 when the machine was powered off or idled, is purged from ink delivery system 10 as described above.

In accordance with an alternative embodiment of the present invention, shown in FIG. 3, a controller 60 is provided for sending start/stop signals to a pump 70. Pump 70 is a reversible pump, in that it may be operated in both directions, to pump ink from reservoir 32 to air purge chamber 40, or to pump ink from air purge chamber 40 to ink reservoir 32. In the use of an ink delivery system 10 embodying the modification of FIG. 3, ink supply item 14 may be arbitrarily placed at any location with respect to the height or elevation of ink cartridge 12 and air purge chamber 40. Hydrostatic pressure in ink delivery system 10 is not used to evacuate ink from air purge chamber 40 and ink conduit 16. Instead, upon powering off, ink delivery pump 18 is reversed, and pumps ink from air purge chamber 40 and conduit 16 back to ink reservoir 32. After a length of pumping time sufficient to ensure that the air/liquid boundary has reached the hydrophilic mesh of filter 52, the pump powers off and acts as a valve, preventing ink flow in either direction.

A further modification of the present invention is shown in FIG. 4, wherein an ink reservoir 80 comprises a back pressure device, such as a spring loaded bladder. Other back pressure devices may be used in ink supply item 14, in place of a spring loaded bladder. The back pressure device is capable of drawing ink back into ink supply item 14 when pump 18 is deactivated. Pump 18 need not be reversible, and the back pressure device contained within ink supply item 14 is used instead, to draw ink from air purge chamber 40 and conduit 16 to ink supply item 14.

For any of the embodiment of ink delivery system 10, placing the hydrophilic mesh of filter 52 in second length **16*b* of conduit 16, between pump 18 and air purge chamber 40, reduces the potential for pump 18** to deprime during prolonged period of inactivity.

The present invention provides a system capable of removing air trapped in an ink delivery system. Further, the ink delivery system of the present invention evacuates ink from the ink conduit interconnecting an ink reservoir and print cartridge, thereby eliminating problems which may occur if ink remains for extended periods of time in the conduit and either absorbs or dissolves air therein, or becomes hardened within the conduit.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An ink delivery system comprising:

an ink cartridge;

an ink supply item remote from said ink cartridge, said ink supply item including an ink reservoir for containing a supply of ink;

an air purge chamber in flow communication between said reservoir and said cartridge, said air purge chamber including a vent with a plug of porous polytetrafluoroetylene in said vent, and an outlet in fluid flow communication with said cartridge, said outlet including a check valve; and a conduit connecting said air purge chamber and said reservoir in fluid flow communication, for delivering ink from said reservoir to said air purge chamber.

2. An ink delivery system comprising:

an ink cartridge;

an ink supply item remote from said ink cartridge, said ink supply item including an ink reservoir for containing a supply of ink;

an air purge chamber in flow communication between said reservoir and said cartridge, said air purge chamber including a vent with a plug of hydrophobic material in said vent and an outlet in fluid flow communication with said cartridge, said outlet including a check valve;

a conduit connecting said air purge chamber and said reservoir in fluid flow communication, for delivering ink from said reservoir to said air purge chamber;

a pump for delivering ink from said ink reservoir to said cartridge; and a filter of hydrophilic mesh in said conduit.

3. The ink delivery system of claim 2, said hydrophilic mesh being upstream of said pump.

4. The ink delivery system of claim 2, said hydrophilic mesh being downstream of said pump.

5. An ink delivery system comprising:

an ink cartridge;

an ink supply item remote from said ink cartridge, said ink supply item including an ink reservoir for contain a supply of ink;

an air purge chamber in flow communication between said reservoir and said cartridge, said air purge chamber including a vent with a plug of hydrophobic material in said vent, and an outlet in fluid flow communication with said cartridge, said outlet including a check valve;

a conduit connecting said air purge chamber and said reservoir in fluid flow communication, for delivering ink from said reservoir to said air purge chamber; and a filter of hydrophilic mesh in said conduit.

6. The ink delivery system of claim 5, said ink reservoir being disposed at a location lower than said air purge chamber.

7. The ink delivery system of claim 6, including a pump for delivering ink from said reservoir to said air purge chamber.

8. An ink delivery system comprising:

an ink cartridge;

an ink supply item remote from said ink cartridge, said ink supply item including an ink reservoir for containing a supply of ink;

an air purge chamber in flow communication between said reservoir and said cartridge, said air purge chamber including a vent with a plug of hydrophobic material in said vent, and an outlet in fluid flow communication with said cartridge, said outlet including a check valve;

a conduit connecting said air purge chamber and said reservoir in fluid flow communication, for delivering ink from said reservoir to said air purge chamber; and a reversible pump disposed in said conduit and a controller for actuating said pump to alternatively drive ink from said ink reservoir to said air purge chamber, and from said air purge chamber to said ink reservoir.

9. The ink delivery system of claim 8, including a filter of hydrophilic mesh in said conduit upstream of said reversible pump.

10. The ink delivery system of claim 8, including a filter of hydrophilic mesh in said conduit downstream of said reversible pump.

11. An ink delivery system comprising:

an ink cartridge;

an ink supply item remote from said ink cartridge, said ink supply item including an ink reservoir for containing a supply of ink;

an air purge chamber in flow communication between said reservoir and said cartridge, said air purge chamber including a vent with a plug of hydrophobic material in said vent, and an outlet in fluid flow communication with said cartridge, said outlet including a check valve; and a conduit connecting said air purge chamber and said reservoir in fluid flow communication, for delivering ink from said reservoir to said air purge chamber; and a backpressure device associated with said ink supply item.

12. At ink delivery system comprising:

an ink cartridge;

an ink supply item remote from said ink cartridge, said ink supply item including an ink reservoir for containing a supply of ink, said ink reservoir being a spring loaded bladder;

an air purge chamber in flow communication between said reservoir and said cartridge, said air purge chamber including a vent with a plug of hydrophobic material in said vent, and an outlet in fluid flow communication with said cartridge, said outlet including a check valve; and a conduit connecting said air purge chamber and said reservoir in fluid flow communication, for delivering ink from said reservoir to said air purge chamber.

13. An air purging system for an ink delivery system having a print cartridge and a remote ink reservoir, with a pump for delivering ink from said ink reservoir to said cartridge through a conduit, said air purge system comprising:

an air purge chamber disposed in fluid flow communication between said ink reservoir and said cartridge, said air purge chamber including:

an inlet connected in flow communication to receive ink from said ink reservoir;

an outlet having a check valve connected in flow commutation to provide ink to said cartridge, said check valve being a pressure actuated check valve in said chamber outlet; and a vent open to an ambient environment, said vent having a plug of hydrophobic material therein for readily passing air therethrough while inhibiting the passing of ink therethrough.

14. An air purging system for an ink delivery system having a print cartridge and a remote ink reservoir, with a pump for delivering ink from said ink reservoir to said cartridge trough a conduit, said air purging system comprising:

an air purge chamber disposed in fluid flow communion between said ink reservoir and said cartridge, said air purge chamber including:

an inlet connected in flow communication to receive ink from said ink reservoir;

an outlet having a check valve connected in flow communication to provide ink to said cartridge; and a vent open to an ambient environment, said vent having a plug of hydrophobic material therein for readily passing air therethrough while inhibiting the passing of ink therethrough; and a filter of hydrophilic material in flow communication between said chamber inlet and said ink reservoir.

15. The air purging system of claim 14, said pump having a pump inlet and a pump outlet, and said filter of hydrophilic material disposed in flow communication between said ink reservoir and said pump inlet.

16. The air purging system of claim 14, said pump having a pump inlet and a pump outlet, and said filter of hydrophilic material disposed in flow communication between said pump outlet and said chamber inlet.

17. An air purging system for an ink delivery system having a print cartridge and a remote ink reservoir, with a pump for delivering ink from said ink reservoir to said cartridge through a conduit, said air purge system comprising:

an air purge chamber disposed in fluid flow communication between said ink reservoir and said cartridge, said air purge chamber including:

an inlet connected in flow communication to receive ink from said ink reservoir;

an outlet having a check valve connected in flow communication to provide ink to said cartridge; and a vent open to an ambient environment, said vent having a plug of hydrophobic material therein for readily passing air therethrough while inhibiting the passing of ink therethrough; and a backpressure device associated with said ink reservoir.

18. The air purging system of claim 17, said ink reservoir being a spring loaded bladder.

19. An air purging system for an ink delivery system having a print cartridge and a remote ink reservoir, with a pump for delivering ink from said ink reservoir to said cartridge through a conduit, said air purging system comprising:

an air purge chamber disposed in fluid flow communication between said ink reservoir and said cartridge, said air purge chamber including:

an inlet connected in flow communication to receive ink from said ink reservoir;

an outlet having a check valve connected in flow communication to provide ink to said cartridge; and a vent open to an ambient environment, said vent having a plug of hydrophobic material therein for readily passing air therethrough while inhibiting the passing of ink therethrough; and said pump being a reversible pump, and said air purge system including a controller for said pump, said pump adapted for alternatively pumping ink from said ink reservoir into said air purge chamber and from said air purge chamber into said ink reservoir.

20. The air purging system of claim 19, including a filter of hydrophilic material between said air purge chamber and said ink reservoir.

21. The air purging system of claim 20, said hydrophilic material disposed between said ink reservoir and said pump.

22. The air purging system of claim 20, said hydrophilic material disposed between said pump and said air purge chamber.

23. A method for delivery ink from a remote reservoir to an ink cartridge, comprising steps of:

providing an air purge chamber disposed in fluid flow communication between the reservoir and the cartridge, the air purge chamber including an inlet connected in flow communication to receive ink from the reservoir and an outlet connected in flow communication to provide ink to the cartridge; and providing a vent in the chamber open to an ambient environment, and a plug of hydrophobic material in the vent;

pumping ink from the reservoir to the chamber in response to a demand for ink by the ink cartridge; and passing air from the chamber to the ambient environment through the vent; and closing the chamber outlet and moving ink to the ink reservoir upon cessation of a demand for ink by the ink cartridge, said moving ink performed by one of draining, pumping and drawing ink to the ink reservoir.

* * * * *